US006972406B2

(12) United States Patent
Syms

(10) Patent No.: US 6,972,406 B2
(45) Date of Patent: Dec. 6, 2005

(54) MASS SPECTROMETRY

(75) Inventor: Richard Syms, London (GB)

(73) Assignee: Microsaic Systems Limited, London (GB)

( * ) Notice: Subject to any disclaimer, the term of this patent is extended or adjusted under 35 U.S.C. 154(b) by 0 days.

(21) Appl. No.: 10/503,516

(22) PCT Filed: Jan. 27, 2003

(86) PCT No.: PCT/GB03/00312

§ 371 (c)(1),
(2), (4) Date: Aug. 4, 2004

(87) PCT Pub. No.: WO03/067626

PCT Pub. Date: Aug. 14, 2003

(65) Prior Publication Data

US 2005/0077897 A1 Apr. 14, 2005

(30) Foreign Application Priority Data

Feb. 5, 2002 (GB) ..... 0202665

(51) Int. Cl.[7] ..... H01J 49/00
(52) U.S. Cl. ..... 250/281
(58) Field of Search ..... 250/281, 288

(56) References Cited

U.S. PATENT DOCUMENTS

| | | | |
|---|---|---|---|
| 5,386,115 | A | 1/1995 | Freidhoff et al. |
| 5,401,962 | A | 3/1995 | Ferran |
| 5,401,963 | A | 3/1995 | Sittler |
| 5,457,355 | A | 10/1995 | Fleming |
| 5,492,867 | A | 2/1996 | Kotvas et al. |
| 5,536,939 | A | 7/1996 | Freidhoff et al. |
| 5,613,294 | A | 3/1997 | Ferran |
| 5,719,393 | A | 2/1998 | Chutjian et al. |
| 5,747,815 | A | 5/1998 | Young et al. |
| 5,850,084 | A | 12/1998 | Holkeboer |
| 6,025,591 | A | 2/2000 | Taylor et al. |
| 6,188,067 | B1 | 2/2001 | Chutjian et al. |
| 2003/0049899 | A1 * | 3/2003 | Syms ..... 438/200 |

OTHER PUBLICATIONS

Turnsall, T.T. et al. *Silicon Micromachined Mass Filter for a Low Power, Low Cost Quadrupole Mass Spectrometer,* © 1998 IEEE, pp. 438-442.

(Continued)

*Primary Examiner*—Kiet T. Nguyen
(74) *Attorney, Agent, or Firm*—Wallenstein Wagner & Rockey, Ltd.

(57) ABSTRACT

A method of fabricating miniature quadrupole electrostatic mass filter has been previously described. The electrodes are metallised cylinders, mounted in grooves etched in oxidised silicon substrates, which are held apart at the correct spacing by cylindrical spacer rods. This invention concerns an ion source mounted on extensions of the spacer rods, which project beyond the mass filter. The ion source consists of a cold-cathode electron emitter, which emits electrons with energies sufficient to cause impact ionisation, and electrostatic optics suitable for coupling the ion flux into the mass filter. Methods of constructing a single self-aligned electron source and a similar dual source are described. Arrangements for mounting the electron source and the ion coupling lens so that the electron and ion beams travel at right angles to one another for efficient separation are described. A method of fabricating a self-aligned one-dimensional einzel electrostatic lens from metallised cylinders mounted in the silicon substrates using etched grooves is described. A method of fabricating a-self-aligned two-dimensional einzel lens from metal plates is also described.

16 Claims, 16 Drawing Sheets

OTHER PUBLICATIONS

Wells, J.M. *A Quadrupole Ion Trap with Cylindrical Geometry Operated in the Mass-Selective Instability Mode Analytical Chemistry,* vol. 70 (1998), pp. 438-444.

Badman, E.R. *A Miniature Cylindrical Quadrupole Ion Trap: Simulation and Experiment Analytical Chemistry,* vol. 70 (1998), pp. 4896-4901.

Chang, T.H.P. *Arrayed Miniature Electron Beam Columns for High Throughput Sub-100 NM Lithography Journal of Vacuum Science Technology,* vol. 10(6) (Nov./Dec. 1992), pp. 2743-2748.

Ouyang, Z. *Characterization of a Serial Array of Miniature Cylindrical Ion Trap Mass Analyzers Rapid Communications in Mass Spectrometry,* vol. 13 (1999), pp. 2444-2449.

Syms, R.R.A. *Design of a Microengineered Electrostatic Quadrupole Lens IEEE Transactions on Electron Devices,* vol. 45, No. 11 (Nov. 1998), pp. 2304-2311.

Freidhoff, C.B. *Chemical Sensing Using Nonoptical Microelectromechanical Systems Journal of Vacuum Science Technology,* vol. 17(4) (1999), pp. 2300-2307.

Fleming, J.G. *Fabrication and Testing of Vertical Metal Edge Emitters with Well Defined Gate to Emitter Separation Journal of Vacuum Science Technology,* vol. 14(3) (1996), pp. 1958-1962.

Ferran, R.J. *High-Pressure Effects in Miniature Arrays of Quarupole Analyzers for Residual Gas Analysis from $10^{-9}$ to $10^{-2}$ Torr Journal of Vacuum Science Technology,* vol. 14(3) (1996), pp. 1258-1265.

Syms, R.R.A. *Fabrication of a Microengineered Quadrupole Electrostatic Lens Electronics Letters,* vol. 32, No. 22 (Oct. 24, 1996), pp. 2094-2095.

Kornienko, O. *Field-Emission Cold-Cathode EI Source for a Microscale Ion Trap Mass Spectrometer Analytical Chemistry,* vol 72 (2000), pp. 559-562.

Hofmann, W. *Fabrication of Integrated Micromachined Electron Guns Journal of Vacuum Science Technology,* vol. 13(6) (Nov./Dec. 1995), pp. 2701-2704.

Itoh, J. *Fabrication of Double-Gates Si Field Emitter Arrays for Focused Electron Beam Generation Journal of Vacuum Science Technology,* vol. 13(5) (Sep./Oct. 1995), pp. 1968-1972.

Despont, M. *Microfabrication of Lenses for a Miniaturized Electron Column Microelectronic Engineering,* vol. 27 (1995), pp. 467-470.

Kornienko, O. *Micro Ion Trap Mass Spectrometry Rapid Communications in Mass Spectrometry,* vol. 13 (1999), pp. 50-53.

Badman, E.R. *Miniature Mass Analyzers Journal of Mass Spectrometry,* vol. 35 (2000), pp. 659-671.

Spindt, C.A. *Physical Properties of Thin-Film Field Emission Cathodes with Molybdenum Cones Journal of Applied Physics,* vol. 47, No. 12 (Dec. 1976), pp. 5248-5263.

Holkeboer, D.H. *Miniature Quadrupole Residual Gas Analyzer for Process Monitoring at milliTorr Pressures Journal of Vacuum Science Technology,* vol. 16(3) (May/Jun. 1998), pp. 1157-1162.

Taylor, S. *Performance Improvements for a Miniature Quadrupole with a Micromachined Mass Filter Vacuum,* vol. 53 (1999), pp. 203-206.

Henry, C.M. *The Incredible Shrinking Mass Spectrometers Analytical Chemistry News & Features,* (Apr. 1, 1999), pp. 264A-268A.

Batey, J.H. *Quadropole Gas Analysers Vacuum,* vol. 35 (1987), pp. 659-668.

Spindt, C.A. *A Thin-Film Field-Emission Cathode Journal of Applied Physics,* vol. 39 (1968), pp. 3504-3505.

Friedhoff, C.N. *Mass Spectrograph on a Chip Proceedings of the IEEE Aerospace Conference,* vol. 3 (Feb. 1-8, 1997), p. 32.

* cited by examiner

MASS SPECTROMETRY

This application claims priority from PCT Application No. PCT/GB03/00312, filed Jan. 27, 2003 (incorporated by reference herein), and British Application No. 0202665.6, filed Feb. 5, 2002 (incorporated by reference herein).

BACKGROUND

Miniature mass spectrometers have application as field-portable devices (for detection of biological and chemical warfare agents, drugs, explosives and pollutants), as instruments for space exploration, and as residual gas analysers. Many systems of reduced size have now been developed, and micro-engineering methods are increasingly being employed in their construction. Mass spectrometers consist of three main subsystems: an ion source, an ion filter, and an ion counter. Since these may all be based on different principles, there is scope for a variety of systems to be constructed.

a) Magnetic Sector and Crossed-Field Instruments

The earliest forms of mass spectrometer constructed using micro-engineered fabrication methods are the two crossed-field (or Wien filter) systems devised at about the same time by Rosemount Analytical Inc. [U.S. Pat. No. 5,401,963] and Westinghouse [U.S. Pat. Nos. 5,386,115; 5,492,867; 5,536,939; 5,747,815; Freidhoff 1997; Freidhoff et al. 1999]. The Rosemount Analytical device is a scanning mass spectrometer based on a fixed magnetic field, a ramped electric field and a single ion detector. However, it is not clear if the device was ever developed.

FIG. 1 shows the Westinghouse device, which is a mass spectrograph based on a continuous ion source, fixed, crossed magnetic and electric fields, and an ion detector array, and which was eventually built by Northrop Grumman [Freidhoff 1997]. The whole mass analyser, except for the electron source, is formed in a shallow cavity etched into a single silicon substrate a few centimeters long. Metal electrodes to control both electron and ion motions are fabricated on the chip by electroplating.

An alternative magnetic micro-engineered mass filter with a non-planar geometry has been proposed by the New Jersey Institute of Technology [Sun et al. 1996]. FIG. 2 shows the device, which uses two orthogonal substrates, one carrying the ion source, and the other a detector array. The ion source is based on an array of cold-cathode field emission tips, and deflection of the ion beam is purely magnetic. While the field emission tips appear to be operating, there are no reports of successful mass filtering yet.

b) Time-of-Flight Instruments

A miniature (but not micro-engineered) spectrometer based on a time-of-flight filter has been under development for a number of years at Johns Hopkins Applied Physics Laboratory [Bryden et al. 1995; Cornish et al. 1999]. The instrument is known as the "Tiny TOF", and is based on a pulsed matrix assisted laser desorption ionisation (MALDI) source and a coaxial reflectron filter, as shown in FIG. 3.

More recently, a time-of-flight mass spectrometer fabricated on a single silicon chip has been announced, but there are no reports of mass filtering [Yoon et al. 2001]. The device is shown in FIG. 4. The electrodes are again deep electroplated metal structures.

c) Instruments with Travelling Wave Filters

A micro-engineered instrument with similar planar electrodes has been proposed [Feustel et al. 1995; Siebert et al 1998]. FIG. 5 shows the device, which uses a continuous ion source and electrostatic filtering. Mass selection is based on the filtering action provided by the interaction between the ion beam and a three-phase travelling electrical field, which is created by a periodic electrode structure. The device contains a plasma ion source, but there are again no reports of successful mass filtering yet.

d) Ion Traps

Several groups have developed mass spectrometers based on miniature ion traps. For example, Purdue University has developed a stainless steel ion trap composed of a cylindrical annular electrode, with an inner radius of 2.5 mm, and flat disc-shape end caps [Wells et al. 1998; Badman et al. 1998; Zheng et al. 1999]. The complete structure is ¼ the radius and $1/64^{th}$ the volume of a commercial hyperbolic traps. Oak Ridge National Laboratory have constructed even smaller ion traps [Kornienko et al. 1999, 2000].

e) Quadrupole Instruments

A number of miniaturised and micro-engineered quadrupole mass spectrometers have been constructed. The most highly developed are two very similar instruments based on square arrays of miniaturised electrostatic quadrupole lenses, demonstrated by Ferran Scientific Inc., San Diego, Calif. [U.S. Pat. No. 5,401,962; Ferran et al. 1996; Boumsellek et al. 1999] and the Jet Propulsion Laboratory (JPL), CA [U.S. Pat. No. 5,719,393 1995; Orient et al 1997]. The advantage of using an array is that parallel operation can lead to recovery of the sensitivity lost by miniaturisation. The square array geometry is particularly efficient, because an array of $N^2$ quadrupoles only requires $(N+1)^2$ electrodes.

FIG. 6 shows the Ferran Micropole™, which is commercially available as a high-pressure residual gas analyser. It consists of a square parallel array of nine quadrupole analysers constructed using sixteen cylindrical metal rods 1 mm in diameter and 20 mm long, mounted in miniature glass-to-metal seals. The ion source is a conventional hot-cathode device. The quadrupoles are driven in parallel by a RF generator, and the ion detector consists of an array of nine Faraday collectors connected together.

The array-type quadrupole mass spectrometer developed by JPL has electrodes that are welded to metallised ceramic jigs. The ioniser is a miniature Nier type design with an iridium-tungsten filament. The detector can be a Faraday cup or a channel-type multiplier. A similarly-constructed device with a single quadrupole lens has been developed by Leybold Infinicon [U.S. Pat. No. 5,850,084; Holkeboer et al. 1998].

Quadrupole lens arrays smaller than the devices described above have been fabricated by exposing a resist to synchrotron radiation and then filling the resulting mould with nickel by electroplating, in a collaboration between JPL and Brookhaven National Laboratory [U.S. Pat. No. 6,188,067; Wiberg et al. 1997]. The lens assembly is a planar element, which is configured into a stacked structure in the complete mass spectrometer.

A different micro-engineered quadrupole lens has been developed Jointly by Inperial College and Liverpool University. The device consists of four cylindrical electrodes mounted in pairs on two oxidised, silicon substrates, that are held apart by two cylindrical spacers as shown in FIG. 7 [U.S. Pat. No. 6,025,591; Syms et al. 1996; Syms et al. 1998; Taylor et al. 1999]. V-shaped grooves formed by anisotropic wet chemical etching are used to locate the electrodes and the spacers. The electrodes are metal-coated glass rods that are soldered to metal films deposited in the grooves.

The mounting method is similar to that used to hold single-mode optical fibres in precision ribbon fibre connectors. In each case, positioning accuracy is achieved by the use of photolithography followed by etching along crystal planes to create kinematic mounts for cylindrical components. However, in the quadrupole lens, the two halves of the structure are also self-aligning. The degree of miniaturisation is only moderate, and operation has been demonstrated using devices with electrodes of 0.5 mm diameter and 30 mm length.

f) Ion Sources

Most of the results from micro-engineered mass filters to date have been obtained from hybrid systems fitted with conventional ion sources, and only limited work has been carried out on micro-fabricated sources.

A conventional impact ionisation source is a vacuum device that consists of an electron source capable of emitting electrons with sufficient energy to perform ionisation, coupled to an arrangement for extracting the resulting ions into the mass analyser. The electron source itself may be based on a number of principles, including emission from a heated or an unheated cathode, or from a plasma that is excited by an RF discharge.

FIG. 8 shows a schematic of a hot-cathode source coupled to a quadrupole mass filter. Current passed through a filament (which is held at a negative voltage $V_1$) causes a rise in temperature sufficient to allow thermionic emission through the action of a field created by the extractor or gate electrode (which is held at a voltage $V_2$ close to ground). The electrons travel towards the collector electrode, which is held at a small positive voltage $V_3$. If these electrons have energies in excess of circa 70 eV, they will cause ionisation by impact of residual gas in the immediate vicinity. Positive ions are preferentially produced.

The ions must be separated from the electrons and coupled into the entrance pupil of the mass filter. An efficient method is to extract the ions in a direction at right angles to that of the electrons, and to perform the coupling by electrostatic focussing. FIG. 8 shows an electrostatic lens of the type generally known as an "einzel" lens performing both tasks.

The einzel lens is a stack of three conducting plates with co-axial circular apertures. The plates are held at voltages $V_4$, $V_5$ and $V_6$. Positive ions are coupled into the mass filter when the voltage $V_5$ applied to the central focus electrode is suitably negative [Batey 1987].

In a micro-engineered implementation, there are difficulties in constructing both the electron source and the lens, with the two systems in the correct relative orientation. The previous FIG. 1 shows a planar realisation of an einzel lens, arranged to extract ions at in a direction at right angles to an ionising electron beam. The lens electrodes are formed using electroplated metal. The previous FIG. 5 shows a similar planar implementation in which the electron source is a plasma. The previous FIG. 4 shows a less efficient in-line arrangement in which the electron source is a heated filament.

An attractive form of electron source is a cold-cathode field emitter, especially for an integrated system that may be unable to dissipate heat effectively. Cold-cathode devices have been highly developed for applications in field emission displays. They are based on room temperature, field-enhanced tunnelling at the apex of a sharp-tipped structure [Fowler and Nordheim 1928]. The development of the first practical devices is due to Spindt [Spindt 1968; Spindt et al. 1976]. The devices are based on cylindrically symmetric sharp tips formed by etching in a material with low work function.

FIG. 9*a* shows the most common geometry for a field-emission triode [Itoh 1995]. Here a sharp, circularly symmetric tip etched in a conducting substrate acts as the cathode or electron emitter. A planar conducting layer spaced from the substrate by a thin, high quality insulator acts as the gate electrode. A separate conducting layer acts as the anode or electron collector. Electron emission takes place vertically, when a high enough field is applied between the gate and the cathode under vacuum. The majority of the electrons reach the anode. Additional electrodes to focus the electron beam have been incorporated in planar (FIG. 9*b*) and stacked (FIG. 9*c*) arrangements, mainly for display applications.

An alternative cold-cathode electron emitter can be formed from a metal film arranged as a vertical knife-edge. FIG. 10 shows a process for fabricating such an emitter [U.S. Pat. No. 5,457,355; Fleming et al. 1996]. The main differences from the previous device are an altered electrostatic field condition and the use of cathode materials other than silicon.

Monolithically integrated electron lenses have also been constructed in a stacked planar arrangement by depositing metal into integrated moulds [Hofmann et al. 1994]. Surface machining of single crystal silicon has also been used for a similar purpose. In this case, the lenses obtained were in the form of vertically stacked cylinders separated by small gaps [Hofmann et al. 1997]. Entire einzel lenses have also been constructed from stacked, etched silicon wafers, as shown in FIG. 11 [Chang et al. 1992; Despont et al. 1995; Lee et al. 1997]. In each of these cases, the intended application (namely, to focus the electron beam in a compact electron gun for lithography) was different from that here.

Cold-cathode electron emitters have been used as ionisation sources in a number of mass filtering experiments involving ion traps [Kornienko et al. 2000]. However, the geometry was relatively simple, and the electrons were simply injected into the trap. Limited progress has been achieved in developing ion sources for planar integrated mass spectrometers based on cold cathode emitters, in an efficient geometry of the type shown in FIG. 8.

SUMMARY OF THE INVENTION

One objective of the present invention is to provide an ion source appropriate for a micro-engineered mass spectrometer. The constraints involved may be identified from the above discussion.

Firstly, to obtain selective mass filtering, the ion flight path must be relatively long. This principle holds whether crossed-field, time-of-flight or quadrupole mass filtering is employed. In most micro-engineered systems (for example, in FIGS. 1, 4 and 5), the ion flight path is therefore arranged to lie parallel to the substrate plane. This arrangement also allows the definition of a relatively complex filter structure.

Secondly, to obtain a large ion flux, a high-power ion source is required. If the source is an electron impact ionisation source, the electron and ion beams should travel at right angles to one another for efficient electrostatic separation, as shown in FIG. 8. This principle is employed in FIGS. 1 and 5, but not in FIG. 4. If the ion path lies in the substrate plane, the electron path should therefore either be perpendicular to the substrate (as shown in FIG. 5) or in the substrate plane, at right angles to ion path (as in FIG. 1).

Accordingly, the present invention provides an electron source device comprising a first substrate with a cathode, a gate and a locating profile on its surface, a second substrate with an anode and a locating profile on its surface and a spacer adapted to cooperate with the locating profiles to maintain the substrates at a set distance and orientation with respect to one another so that the cathode, gate and anode together form an electron source.

In some applications, the electron source should ideally be monolithically integrated, to reduce manufacturing cost. Thus, it is preferred that the substrates be oxidised silicon substrates, the locating profiles be etched grooves and the spacer be an elongate rod.

The cathode may be a cold field-emission cathode comprising a plurality of raised points or a plurality of raised edges.

In particular where the electron source is monolithically integrated, a secondary electron source may be beneficial, to maintain instrument lifetime after failure of the primary source. For this reason, it is preferred that each substrate comprise an cathode and a gate on its surface with the gate on the surface of the second substrate forming the anode. In this way, a dual field-emission electron source is constructed. Thus, if the cathode should fail, the cathode of the first substrate is disconnected, and the gate electrode of the first substrate is connected to an appropriate voltage and used as a temporary anode.

Another objective of the present invention is to provide ion coupling optics appropriate for a micro-engineered mass spectrometer. The constraints involved may again be identified from the above discussion.

To maintain instrument sensitivity, the ion flux (and therefore the entrance pupil) must be relatively large. If the entrance optics consist of electrostatic lenses, these must be set up perpendicular to the direction of the ion beam. In most micro-engineered mass spectrometers employing einzel lenses (for example, FIGS. 1 and 5), the lenses are deep metal structures arranged perpendicular to the substrate.

The lenses may be formed by first creating a deep mould in photo-resist by a lithographic process, and filling the mould with metal by electroplating. However, as the height of the structure rises above around fifty microns, conventional UV photolithography may no longer be used as an exposure tool, due to the high optical absorption of most photo-resists.

Other exposure tools (for example, a synchrotron radiation source) may be used to expose resist up to a thickness of around 1 millimeter, but these are extremely expensive.

In any case, multi-level patterning is required to form a true einzel lens that will focus the ion beam in two perpendicular directions simultaneously. For example, in FIGS. 1 and 5, an einzel lens consisting only of a single layer pattern of the type shown will focus an ion beam only in a plane parallel to the substrate.

A lens with at least three levels of patterning is required to focus an ion beam in a direction perpendicular to the substrate. However, three-level patterning will result in a square or rectangular pupil, rather than a circular pupil. Furthermore, uncertainty in the thickness of any of the individual layers will result in an error in the placement of the lens with respect to the entrance pupil of the mass filter.

In-plane patterning can be used to form an einzel lens with a circular pupil (for example, in FIGS. 9 and 11). However, a complicated stacked structure is required. Furthermore, a lens realised in this orientation is no longer appropriate for focusing an ion beam travelling parallel to the substrate.

Accordingly, the present invention also provides an ion optical device comprising first and second substrates, each with an electrode and a locating profile on its surface, and a spacer adapted to cooperate with the locating profiles to maintain the substrates at a set distance and orientation with respect to one another so that the electrodes together form an ion optical component.

In the case where an ion optical component in the form of a one-dimensional einzel lens is required, the ion optical components may each comprise three cylindrical ion-coupling electrodes. For a monolithic construction, the substrates may be oxidised silicon and the cylindrical ion coupling electrodes are mounted in etched grooves.

In the case where a two-dimensional einzel lens is required, the ion optical electrodes may each comprise a multi-level metal electrode. Since there are two such electrodes, each may simply be a bi-level electrode.

A further objective of the present invention is to provide an ion source device for use in the front end of a micro-engineered mass spectrometer. This is achieved in two ways.

In one alternative, an ion source device is provided comprising:

- an electron source device in accordance with the invention; and
- an ion optical device comprising first and second substrates, each with an electrode and a locating profile on its surface;
- in which the spacer is adapted also to cooperate with the locating profiles of the ion optical device substrates to maintain them at a set distance and orientation with respect to one another so that the electrodes together form an ion optical component.

In a second alternative, an ion source device is provided comprising an electron source device according to the invention in which:

- each of the first and second substrates has an ion optical electrode on its surface; and
- when the spacer cooperates with the locating profiles to maintain the substrates at the said set distance and orientation with respect to one another, the ion optical electrodes together form an ion optical component.

Thus, the first alternative uses the same spacers to locate the ion source substrates and the ion optical device substrates. The second integrates the components of each device onto two cooperating substrates.

One form of mass filter to which the present invention is particularly applicable is the quadrupole filter of FIG. 7. As previously described, this device consists of four cylindrical electrodes mounted in pairs on two oxidised silicon substrates, that are held apart by two cylindrical spacer rods. V-shaped grooves formed by anisotropic etching are used to locate both the electrodes and the spacers. This form of groove can be fabricated by etching (100)-orientated silicon wafers down (111)-orientated crystal planes in (for example) a mixture containing ethylene diamene, pyrocatechol and water, or in a mixture containing potassium hydroxide and water. The same technique can be used to manufacture the substrates of the present invention. The two halves of the structure are self-aligning, so that the correct relative spacing and orientation between the pairs of electrodes is automatically achieved to a high accuracy.

The use of a cold-cathode field emission source with such a mass filter is described in U.S. Pat. No. 6,025,591. However, the source is in an incorrect orientation relative to the filter for efficient separation of the electrons and ions, and is lacking suitable ion entrance optics.

The present invention therefore provides a mass spectrometer device comprising:

an ion source device according to first alternative; and a mass filter device comprising first and second substrates, each with a mass filtering component and a locating profile on its surface;

the spacer being adapted to cooperate with the locating profiles of the mass filter device substrates to maintain them at a set distance and orientation with respect to one another so that the mass filtering components together form a mass filter.

Each silicon substrate preferably carries V-shaped alignment grooves formed by anisotropic etching down crystal planes, with a dimension and spacing identical to the alignment grooves already existing on the quadrupole filter. The electron source may therefore be attached to the filter by placing the two substrates on either side of the spacer rods protruding from the filter. This arrangement is inherently compatible with the filter construction, and allows self-aligned addition of an electron source with an emission direction that is perpendicular to the intended ion flight path. Either half of the source may be removed and replaced as required.

The present invention also provides a mass spectrometer device comprising an ion source device according to the second alternative in which:

each of the first and second substrates has an mass filtering component on its surface; and when the spacer cooperates with the locating profiles to maintain the substrates at the said set distance and orientation with respect to one another, the mass filtering components together form an mass filter.

In this case, because the electron source and filter substrates are combined, the cathode must be insulated from its substrate, which extends beneath the filter and is held at ground potential. If the cathode material is itself silicon, the isolation may be obtained (for example, but not exclusively) by forming the cathodes in a bonded silicon-on-insulator (BSOI) wafer instead of a conventional silicon wafer. A BSOI wafer consists of a layer of single-crystal silicon bonded to an oxidised silicon substrate. The bonded layer may be processed to form a silicon terrace carrying the cathode array, which is isolated from the substrate by the silicon dioxide interlayer. Alternatively, if the cathode is not silicon, the desired isolation may be obtained by other methods involving deposited layers.

Again, the first mass spectrometer device according to the invention uses the same spacer to align the three components; the second integrates them all onto two cooperating substrates.

BRIEF DESCRIPTION OF THE DRAWINGS

The present invention will now be described by way of example with reference to the accompanying drawings, in which.

DETAILED DESCRIPTION OF THE INVENTION

Figure 7:
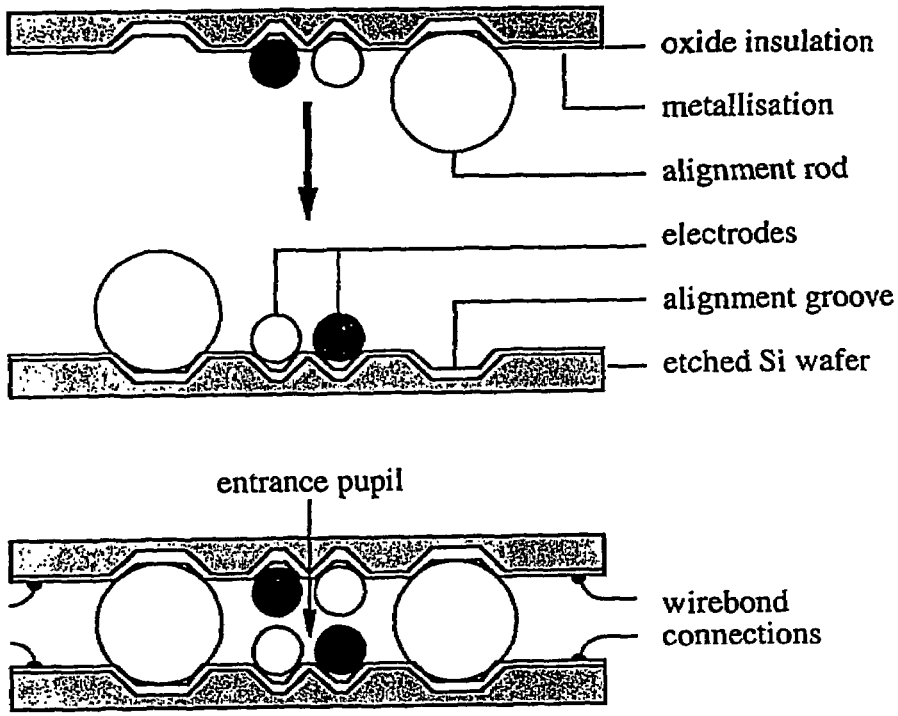
FIG. 7 shows a micro-engineered quadrupole electrostatic lens developed by Imperial College and Liverpool University [U.S. Pat. No. 6,025,591; Syms et al. 1996; Syms et al. 1998]
Figure 8:
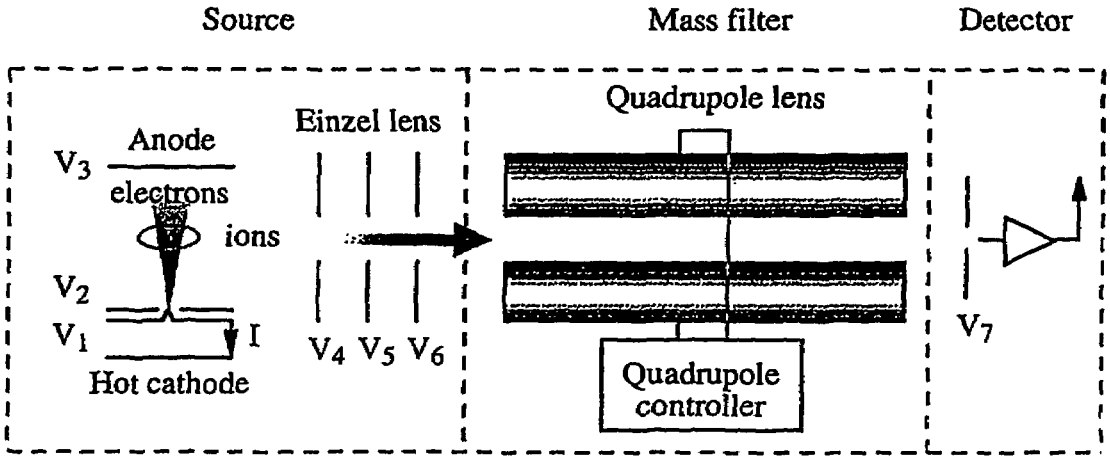
FIG. 8 shows the configuration of an ion source and a quadrupole mass spectrometer.
Figure 12:
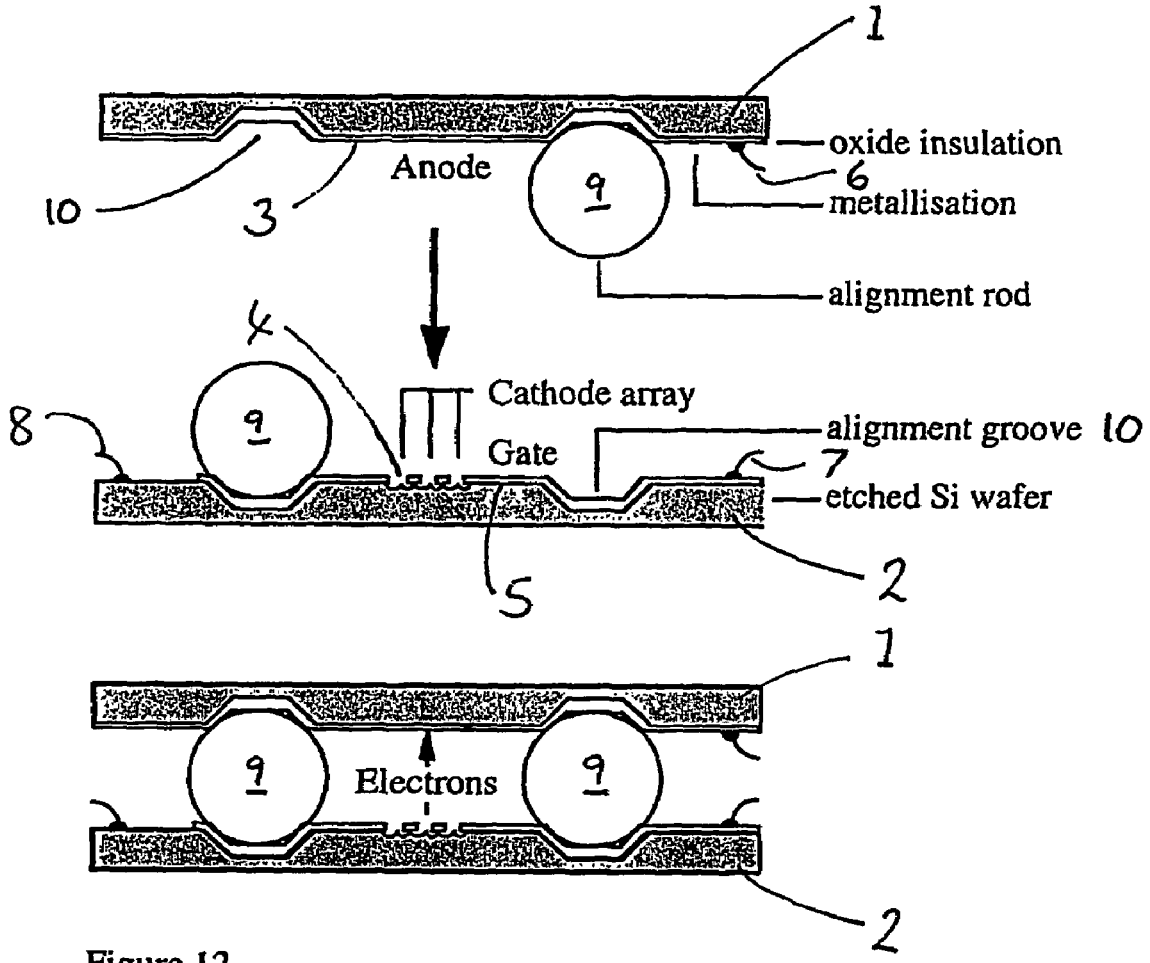
FIG. 12 shows a cold-cathode field emission triode according to the present invention.
Figure 13:
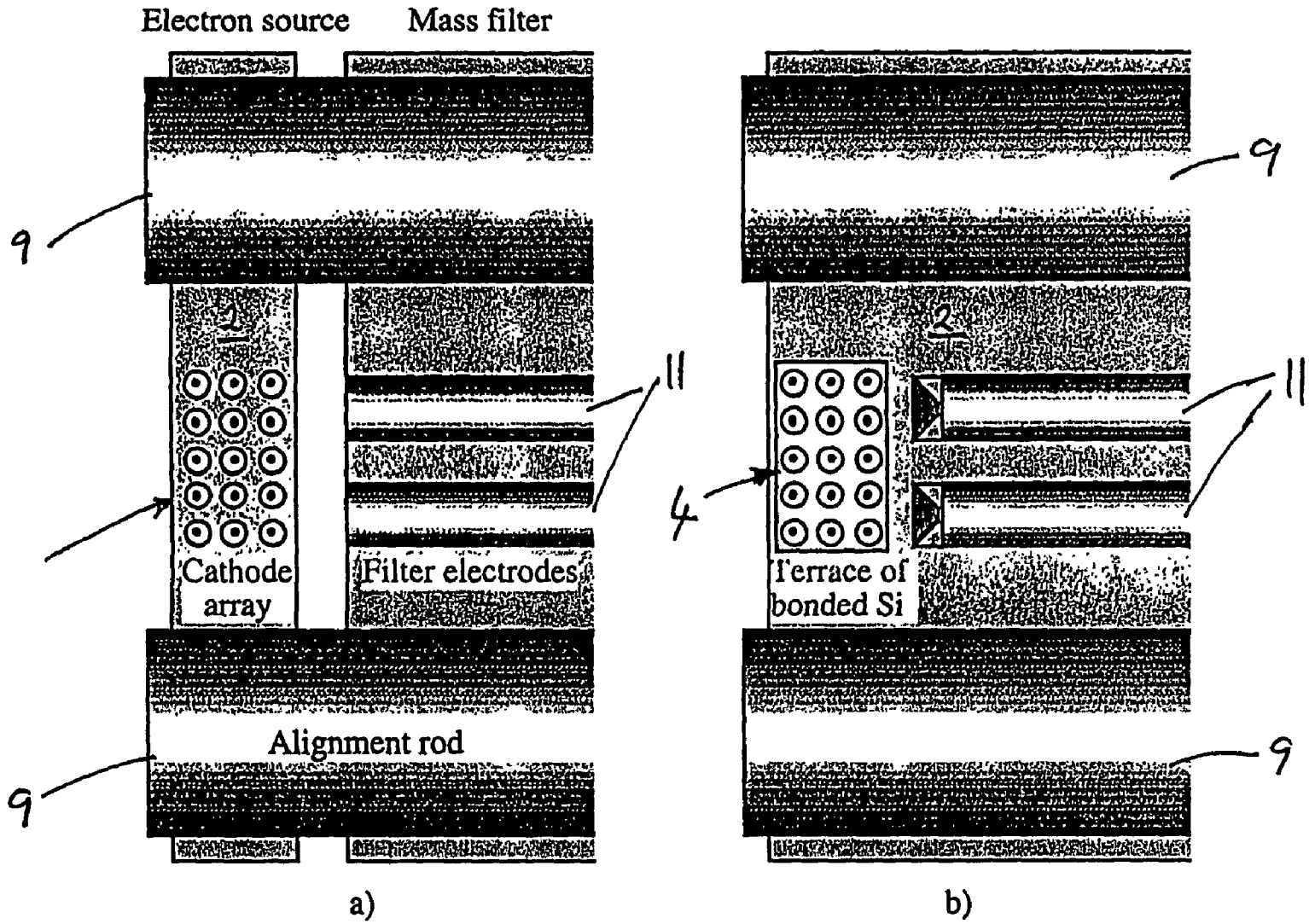
FIG. 13 show two arrangement of a cold-cathode field emission ion source and a mass filter according to the present invention, in which the ion source and mass filter lie on a) separate and b) common substrates.

FIGS. 12 and 13 show the design of a cold-cathode field emission impact ionisation source that is specifically designed for use, with the quadrupole lens mass filter of FIG. 7. As previously described, this device consists of four cylindrical electrodes mounted in pairs on two oxidised silicon substrates, that are held apart by two cylindrical spacer rods. V-shaped grooves formed by anisotropic etching are used to locate both the electrodes and the spacers. This form of groove can be fabricated by etching (100)-orientated silicon wafers down (111)-orientated crystal planes in (for example) a mixture containing ethylene diamene, pyrocatechol and water, or in a mixture containing potassium hydroxide and water. The two halves of the structure are self-aligning, so that the correct relative spacing and orientation between the pairs of electrodes is automatically achieved to a high accuracy.

The overall ion source assembly is illustrated in FIG. 12 and is mounted on extensions of the two cylindrical spacer rods 9, which are here lengthened to project beyond the filter. The electron source is a cold-cathode device, consisting of an array of field emission triodes, with each cathode 4 being controlled by a common gate 5 and a common anode 3, so that the cathodes 4 operate in parallel and a high total emission current is obtained. The emitter is formed on two separate silicon substrates 1, 2. The cathodes 4 and the gate electrode 5 are formed in one substrate 2, and the anode 3 on the other 4. Electrical connections 6, 7, 8 are provided for the anode 3, gate 5 and cathodes 4 respectively.

Figure 9:
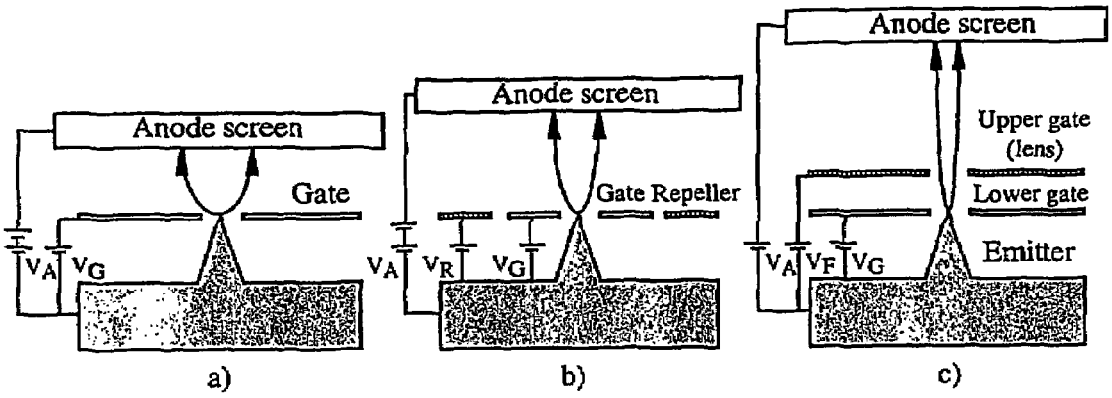
FIG. 9 shows a field emission electron source with focussing electrodes [Itoh 1995]
Figure 11:
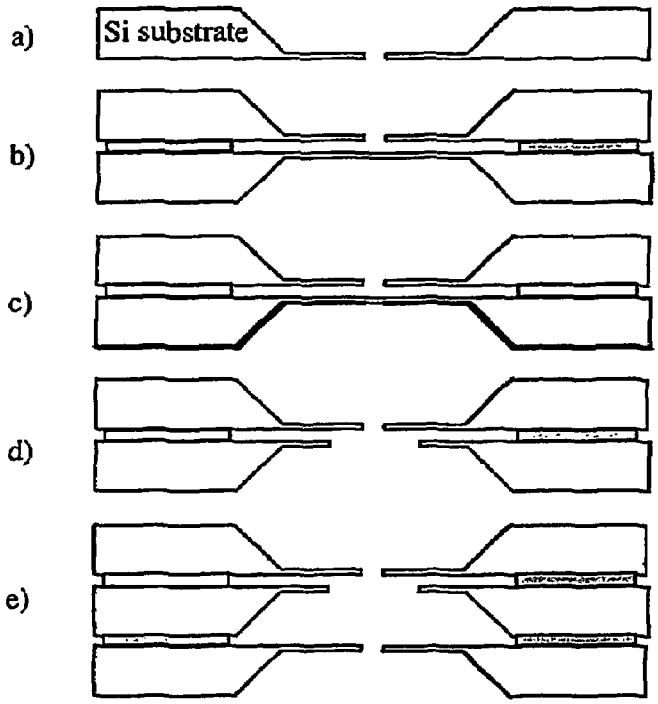
FIG. 11 shows a micro-engineered einzel lens formed from stacked substrates [Despont 1995]
Figure 10:
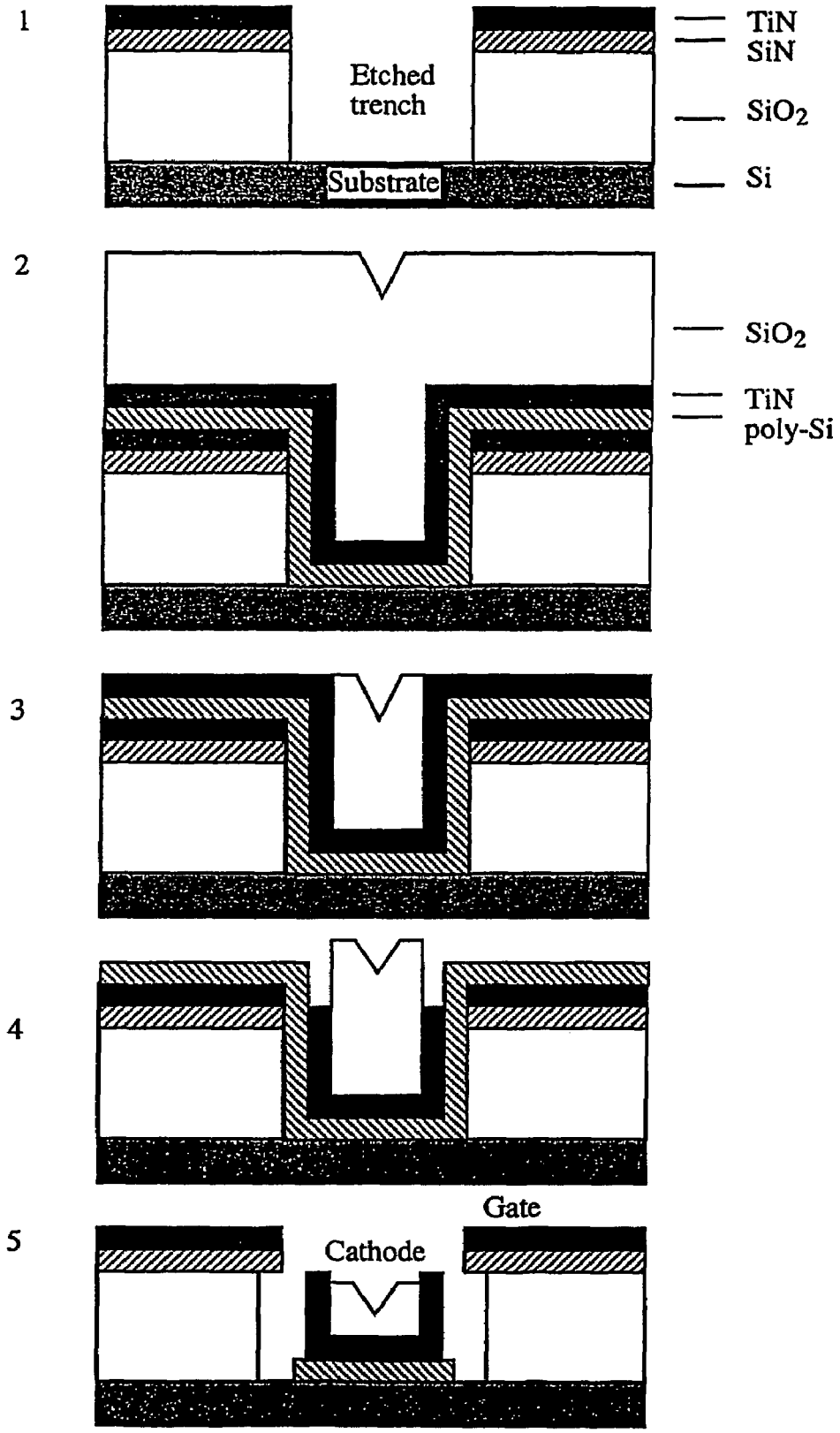
FIG. 10 shows a vertical knife-edge field emission electron source [Fleming et al. 1996]

The cathodes 4 may be formed from an array of etched silicon tips, according (for example, but not exclusively) to FIG. 9. Alternatively, a knife-edge metal emitter may be used, according (again, for example, but not exclusively) to FIG. 10.

Each silicon substrate again carries V-shaped alignment grooves 10 formed by anisotropic etching down crystal planes, with a dimension and spacing identical to the alignment grooves already existing on the quadrupole filter. The electron source may therefore be attached to the filter by placing the two substrates 1, 2 on either side of the spacer rods 9 protruding from the filter. This arrangement is inherently compatible with the filter construction, and allows self-aligned addition of an electron source with an emission direction that is perpendicular to the intended ion flight path.

If the substrates 1, 2 used for the electron source are separate from those used for the filter, as shown in FIG. 13*a*, either half of the source may be removed and replaced as required. The filter electrodes 11 are as illustrated in FIG. 7. Alternatively, the substrate 2 carrying the cathode array 4 and gate 5 may be combined with one of the two filter substrates as shown in FIG. 13*b*, and the substrate 1 carrying the anode 3 may be similarly combined with the other filter substrate, to form an integrated assembly.

In the case when the electron source and filter substrates are combined, the cathode 4 must be insulated from its substrate, which extends beneath the filter and is held at ground potential. If the cathode material is itself silicon, the isolation may be obtained (for example, but not exclusively) by forming the cathodes 4 in a bonded silicon-on-insulator (BSOI) wafer instead of a conventional silicon wafer. A BSOI wafer consists of a layer of single-crystal silicon bonded to an oxidised silicon substrate. The bonded layer may be processed to form a silicon terrace carying the cathode array, which is isolated from the substrate by the silicon dioxide interlayer. Alternatively, if the cathode 4 is not silicon, the desired isolation may be obtained by other methods involving deposited layers.

Figure 14:
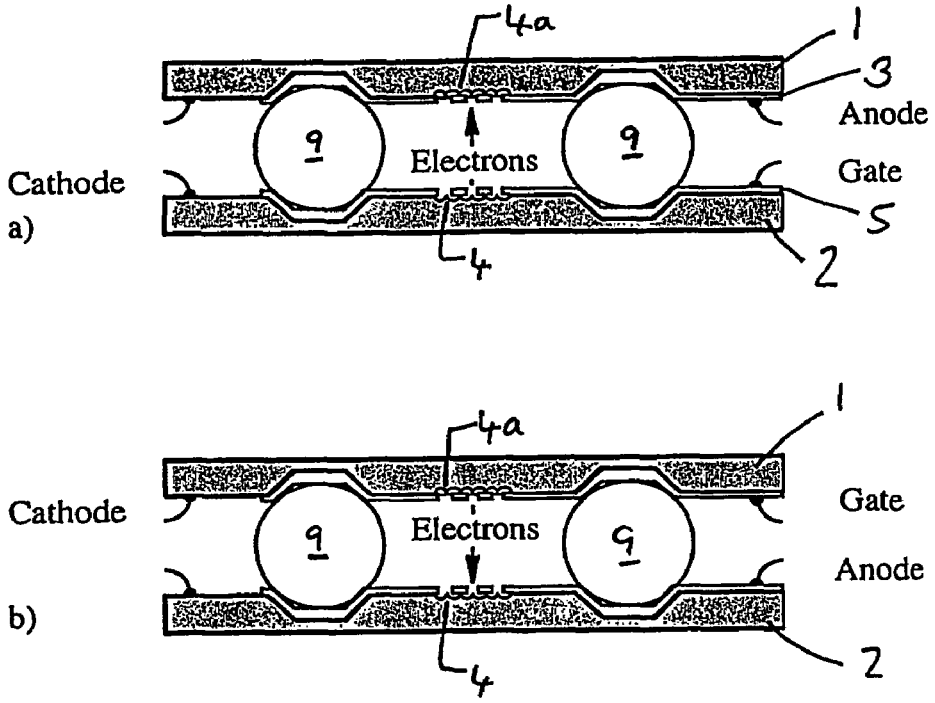
FIG. 14 shows a dual field-emission source according to the present invention, showing the alternative electrical connections required for emission from a) an upper source, and b) a lower source.

A dual field-emission electron source may also be constructed. Two identical substrates are used, each carying an array of cathodes 4, 4*a* and a gate electrode 5, 3, as shown in FIG. 14*a*. To operate the lower source, the cathode 4 and gate electrode 5 of the lower source are connected to appropriate voltages as usual. The cathode 4*a* of the upper source is disconnected, and the gate electrode 3 of the upper source is connected to an appropriate voltage and used as a temporary anode for the lower source. By making simple changes to the electrical connections, the upper source may be operated as shown in FIG. 14*b*. In this way, a secondary electron source may be provided in the case of a failure in the primary source.

Figure 15:
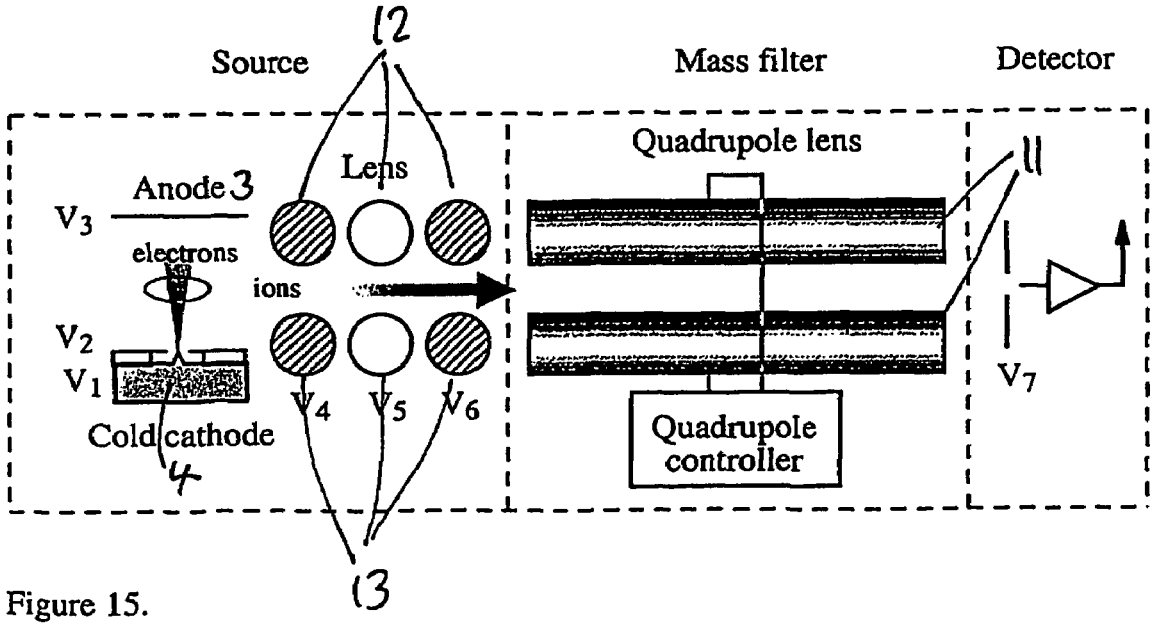
FIG. 15 shows the arrangement of an ion source, ion optics and a quadrupole mass filter according to the present invention, based on a field emission triode electron source and a one-dimensional einzel lens based on cylindrical electrodes.

The ion entrance optics may be constructed by several different methods. A form of einzel lens may be constructed as shown in FIG. 15. Here the three electrodes required are three pairs of parallel cylinders 12, 13, rather than plates containing apertures. This arrangement functions as a lens that focuses the ions in one dimension only.

Figure 16:
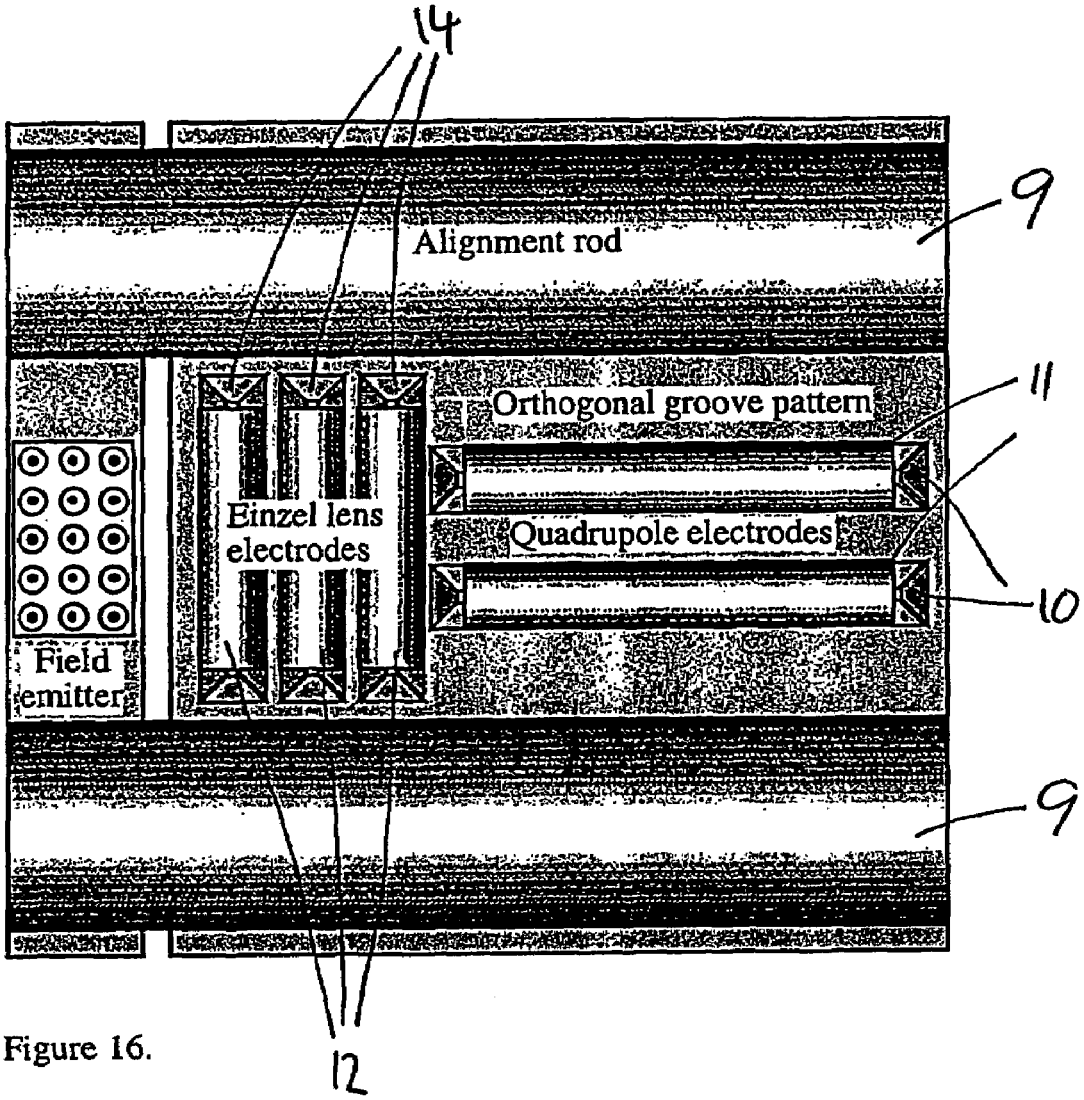
FIG. 16 shows an electron source, a one dimensional einzel lens based on cylindrical electrodes and a quadrupole mass filter according to the present invention.

The cylinders 12, 13 may be mounted in grooves 14 in the silicon substrates as shown in FIG. 16, using the same mounting method as the filter electrodes 11. The required ninety-degree relative orientation of the grooves can be achieved because the two possible lines of intersection between the (111)-oriented planes with the surface of the (100)-orientated silicon wafer lie at ninety degrees to one another.

This process requires no significant modification to the process used to construct the mass filter. All that is required is the photo-lithographic definition of further locating grooves 14, then etching, oxidation and metal coating of those grooves together with existing similar features, and finally soldering of additional electrodes 12 into those grooves.

Figure 17:
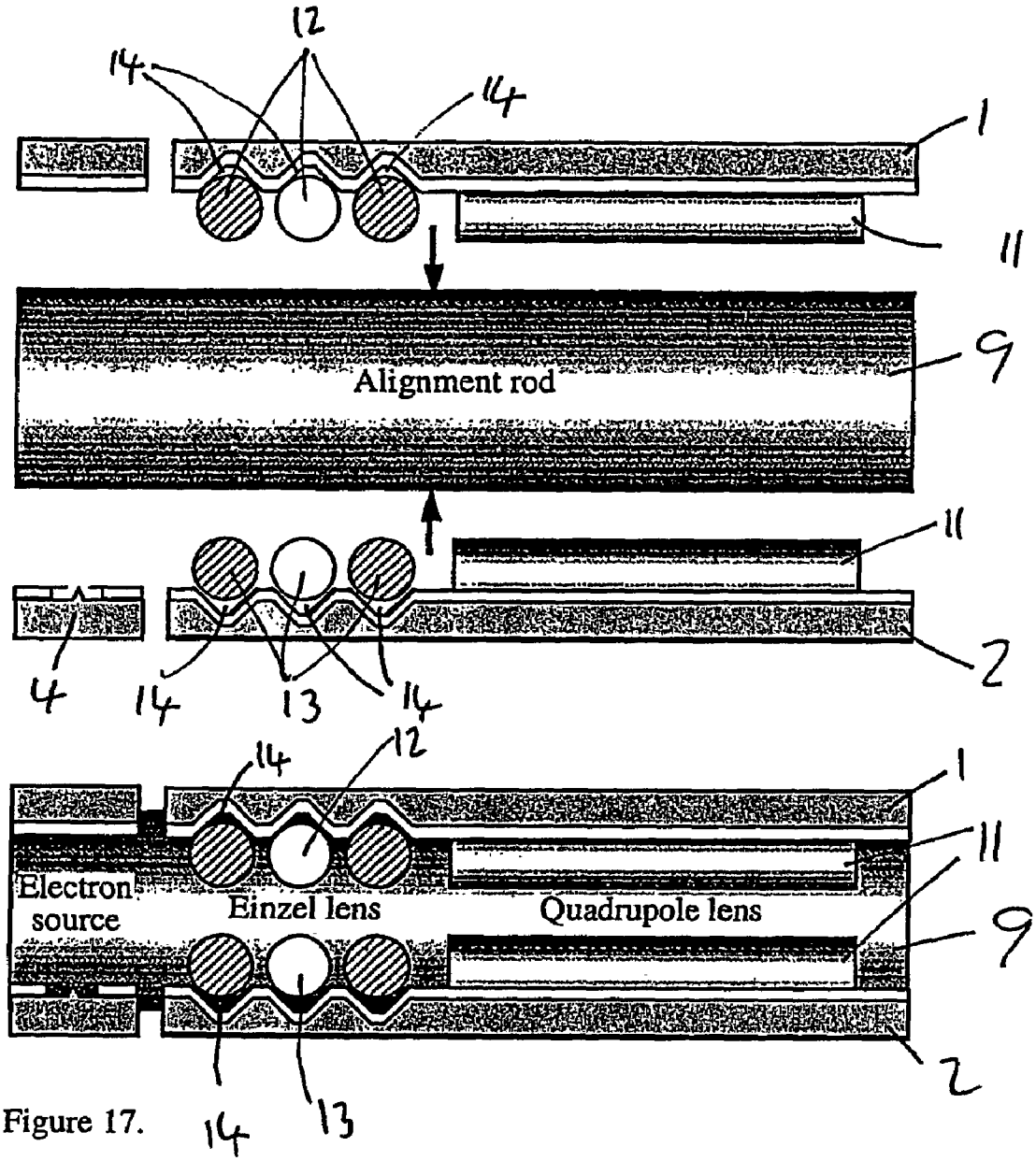
FIG. 17 is a transverse view of the construction of FIG. 16, showing assembly of the substrates on the alignment rods.

Furthermore, the top surface of the electrodes 12 may be located at a significant height above each substrate, without the need for deep lithography and electroplating. That height may be controlled simply by appropriate choice of the width of the alignment groove 14 and the diameter of the cylindrical electrode 12. The two halves of the lens are automatically located symmetrically on either side of the entrance pupil as shown in FIG. 17.

Figure 1:
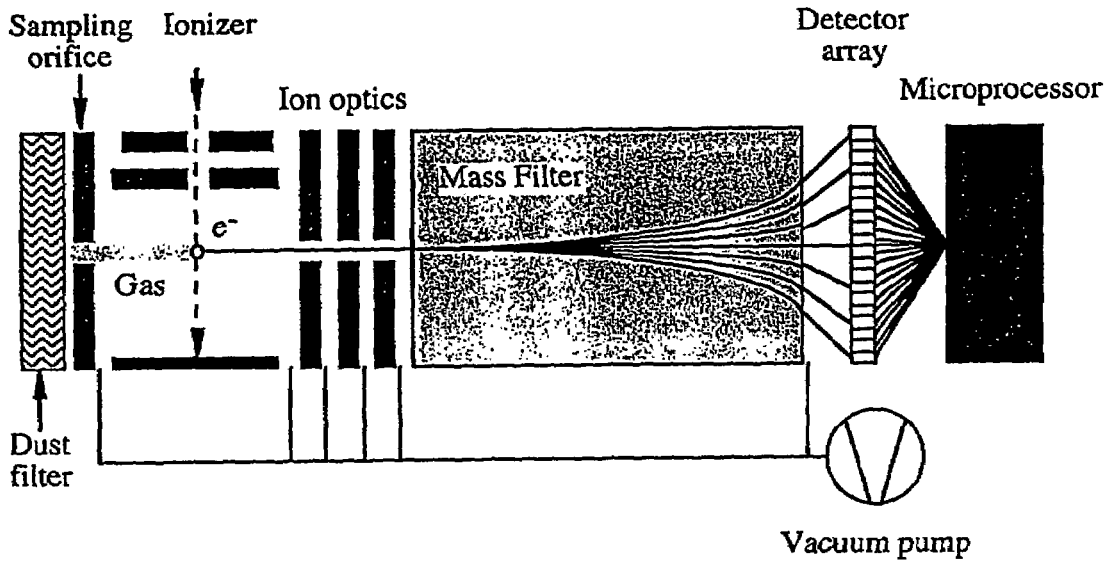
FIG. 1 shows a micro-engineered, crossed-field mass spectrograph developed by Northrop Grumman [U.S. Pat. No. 5,386,115; Freidhoff 1997]
Figure 2:
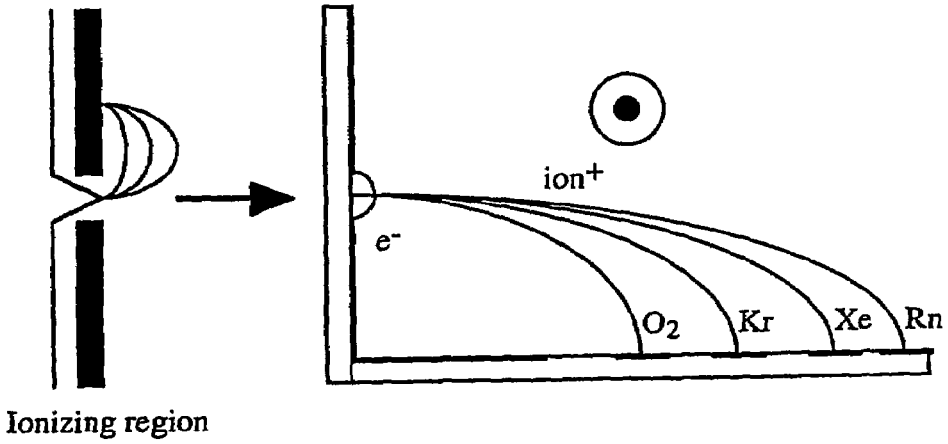
FIG. 2 shows a magnetic sector mass spectrometer under development by the New Jersey Institute of Technology [Sun et al. 1996]
Figure 3:
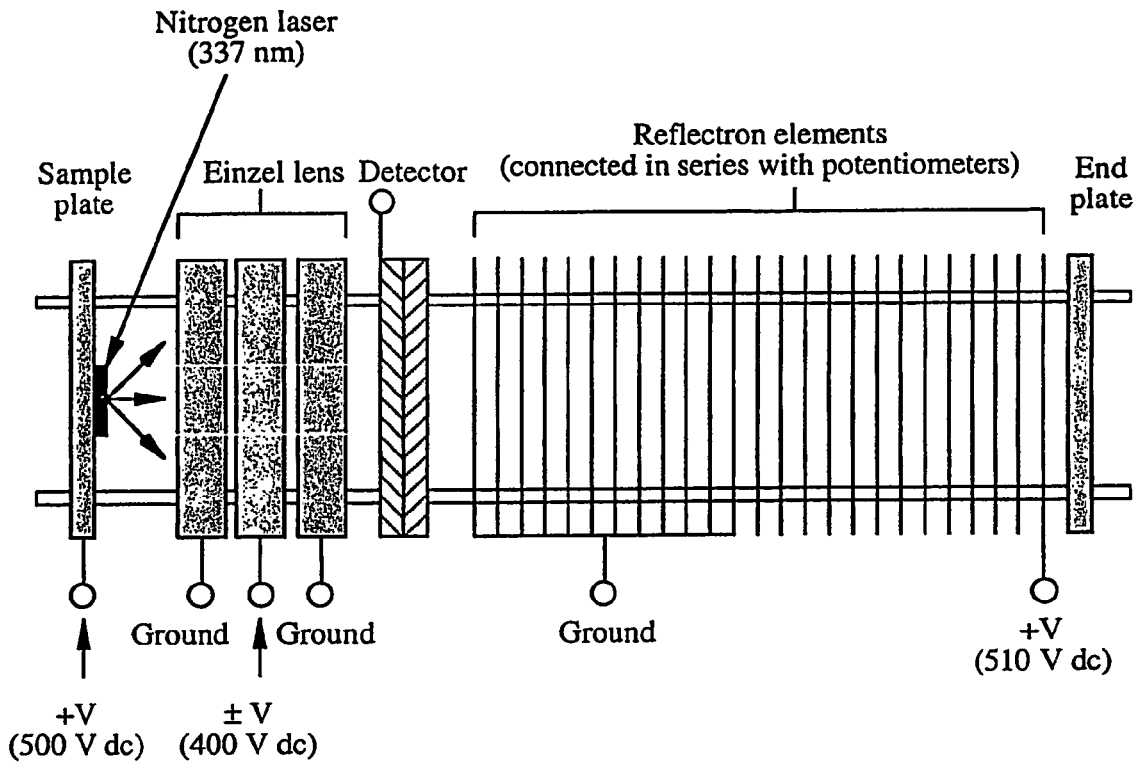
FIG. 3 shows a time-of-flight mass spectrometer developed at Johns Hoplins Applied Physics Laboratory [Bryden et al. 1995]
Figure 4:
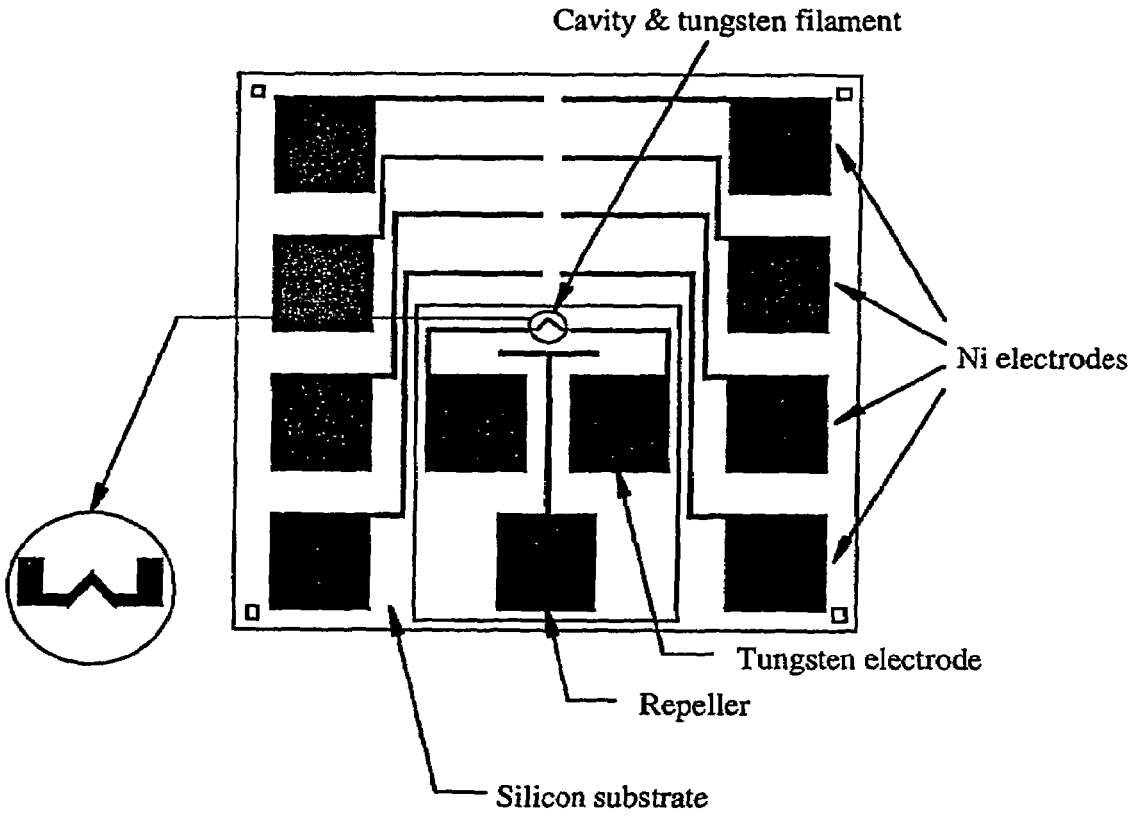
FIG. 4 shows a micro-engineered time-of-flight mass spectrometer [Yoon et al. 2001]
Figure 5:
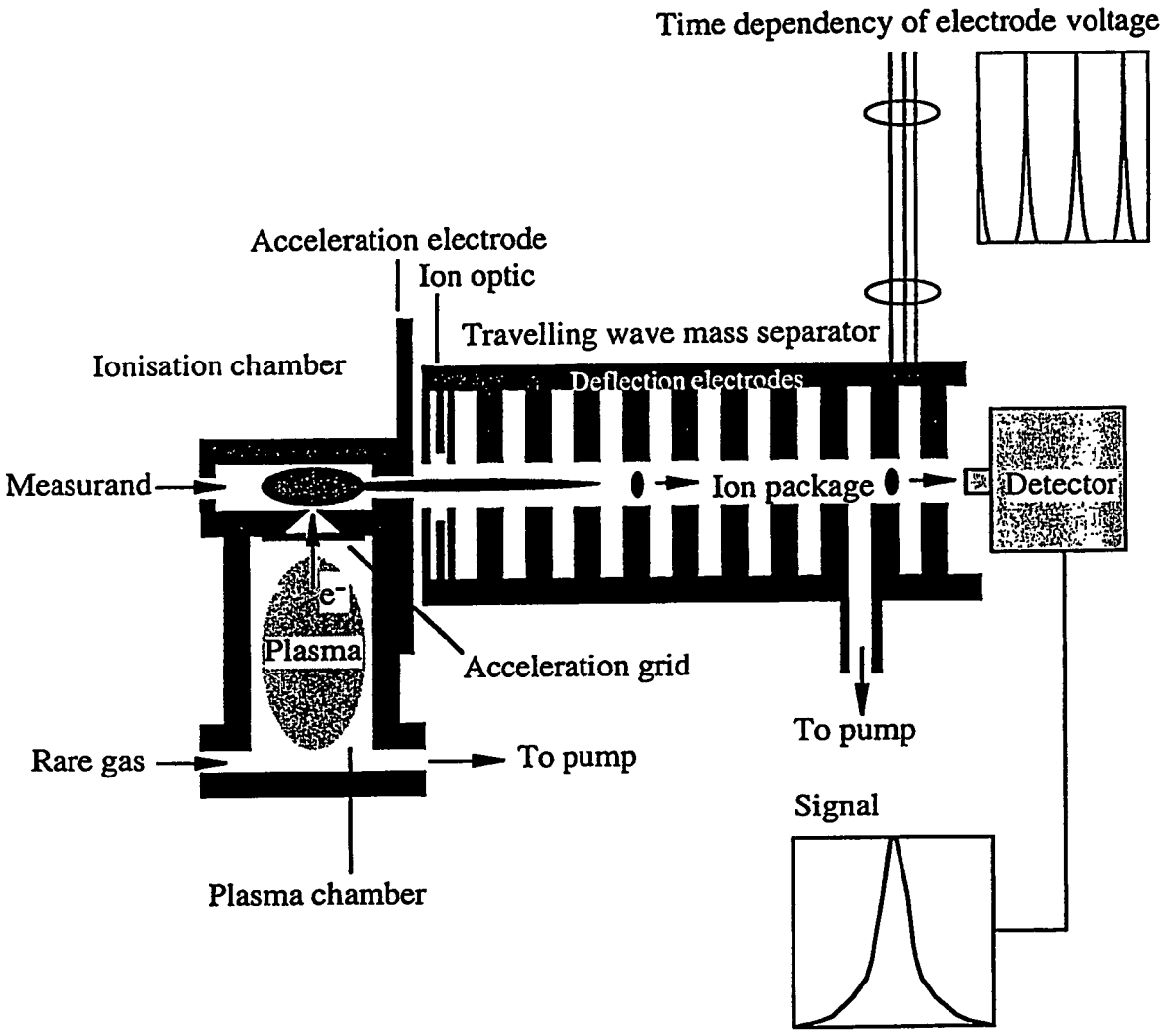
FIG. 5 shows a mass spectrometer with travelling-wave electrodes, proposed by the Technical University of Hamburg-Harburg [Feustel et al. 1995; Siebert et al 1998]
Figure 6:
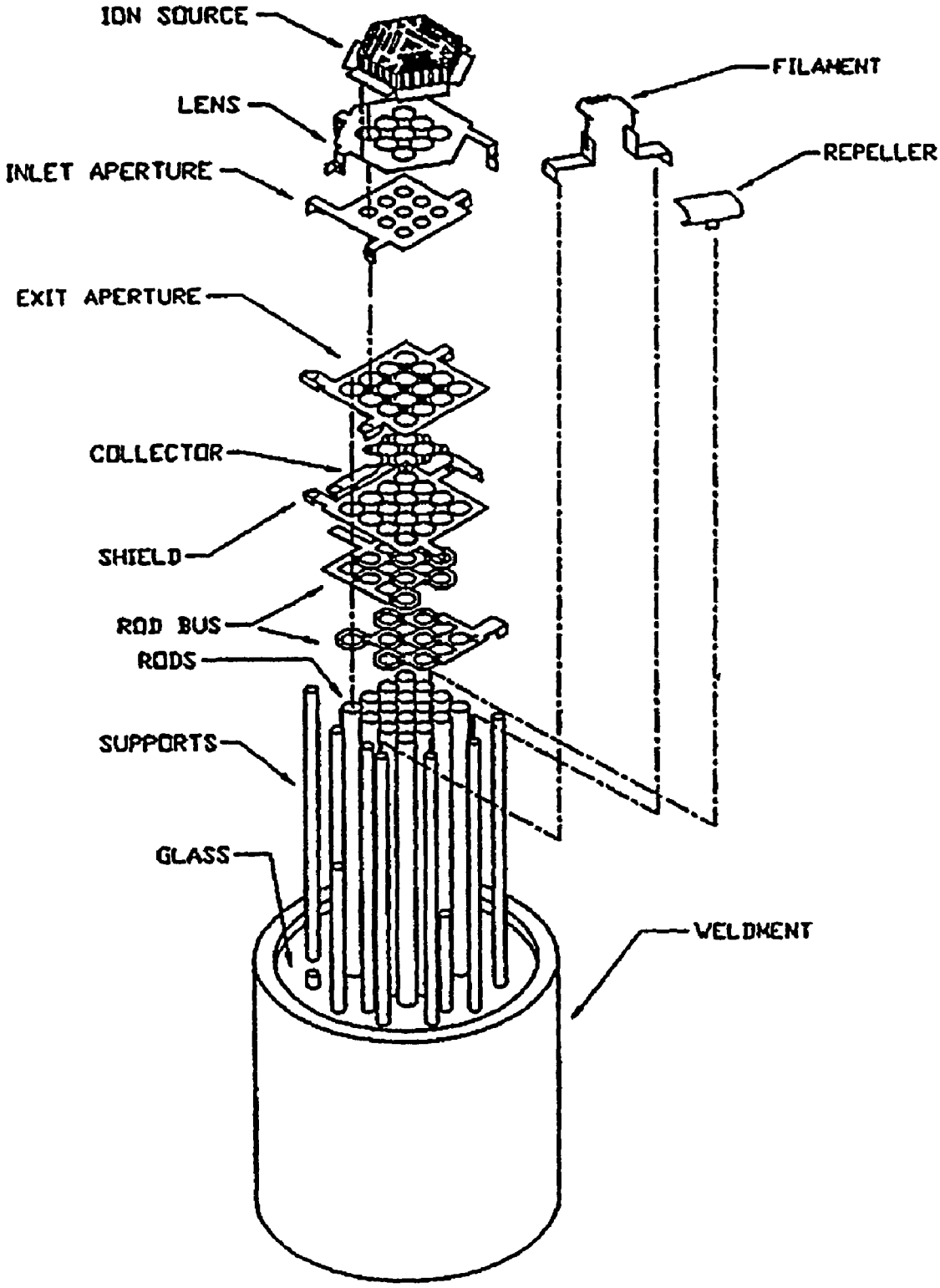
FIG. 6 shows a miniaturised quadrupole mass spectrometer array developed by Ferran [U.S. Pat. No. 5,401,962; Ferran et al. 1996; Boumsellek et al. 1999]

Alternative methods may also be used to form a lens that focuses in two directions, according to the general approach in FIGS. 1 and 5.

Figure 18:
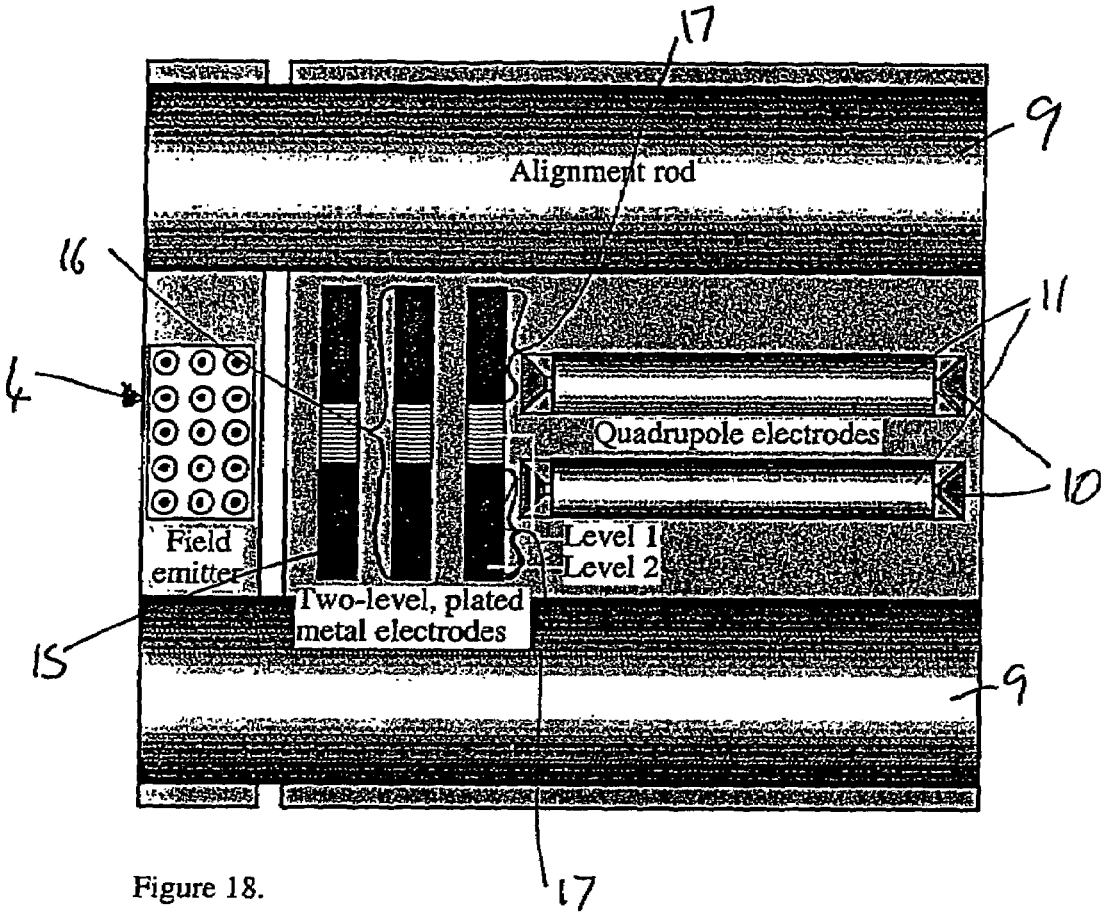
FIG. 18 shows an electron source, a two-dimensional einzel lens based on two-level electroplated metal electrodes and a quadrupole mass filter according to the present invention.

For example, deep photolithography and electroplating may be used to make a two-dimensional einzel lens. However, in the invention here, the lens is constructed in two halves on two separate silicon substrates, as shown in FIG. 18. Each substrate carries a two-level metal structure 15 formed by successive applications of lithography, and electroplating. The structure formed in the level nearest each substrate is a set of three continuous bar electrodes 16. The structure formed on the level furthest from each substrate is a set of three broken bar electrodes 17, superimposed on the lower level structure.

Figure 19:
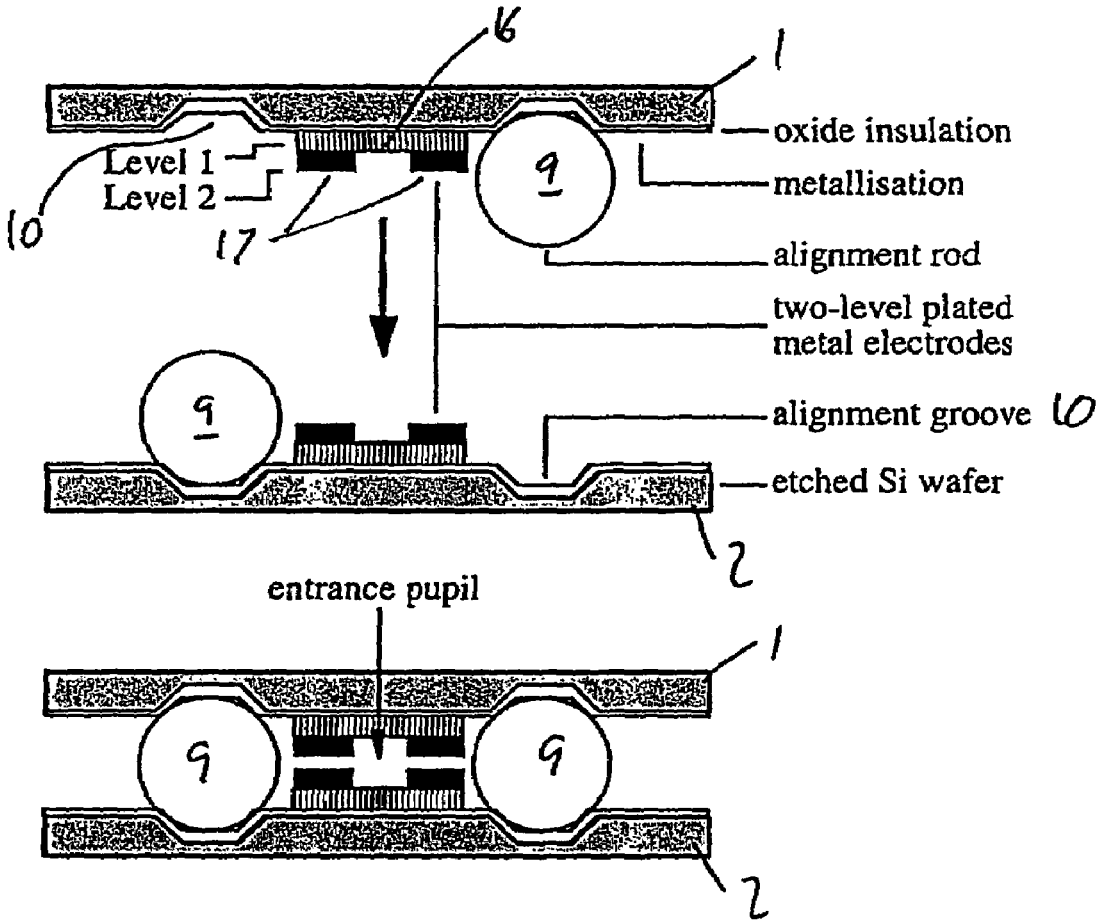
FIG. 19 is an axial view of the construction of FIG. 18, showing the use of the separate electroplated metal structures to give an einzel lens with a split pupil opening.

The two silicon substrates 1, 2 carry etched alignment grooves 10, so that they may be assembled on to a pair of cylindrical spacer rods 9 as shown in FIG. 19. In this case, the two halves of the electroplated metal structure 16, 17 align together to form a lens with a split pupil. Provided the central gap between the electrodes 16, 17 is small, and appropriate and similar voltages are applied to each set of electrodes, this gap is of little significance.

This process of construction requires only two levels of lithography and electroplating. Furthermore, the heights of each level need not be accurately defined. Provided the electrodes are all fabricated in a similar manner, the two halves of the lens are automatically located symmetrically on either side of the entrance pupil.

An alternative method of forming a similar structure is to fabricate two stacked electrode assemblies 16, 17 as entirely separate structures. The assemblies may then simply be soldered to the two substrates 1, 2 in a perpendicular orientation at the entrance to the mass filter.

Figure 20:
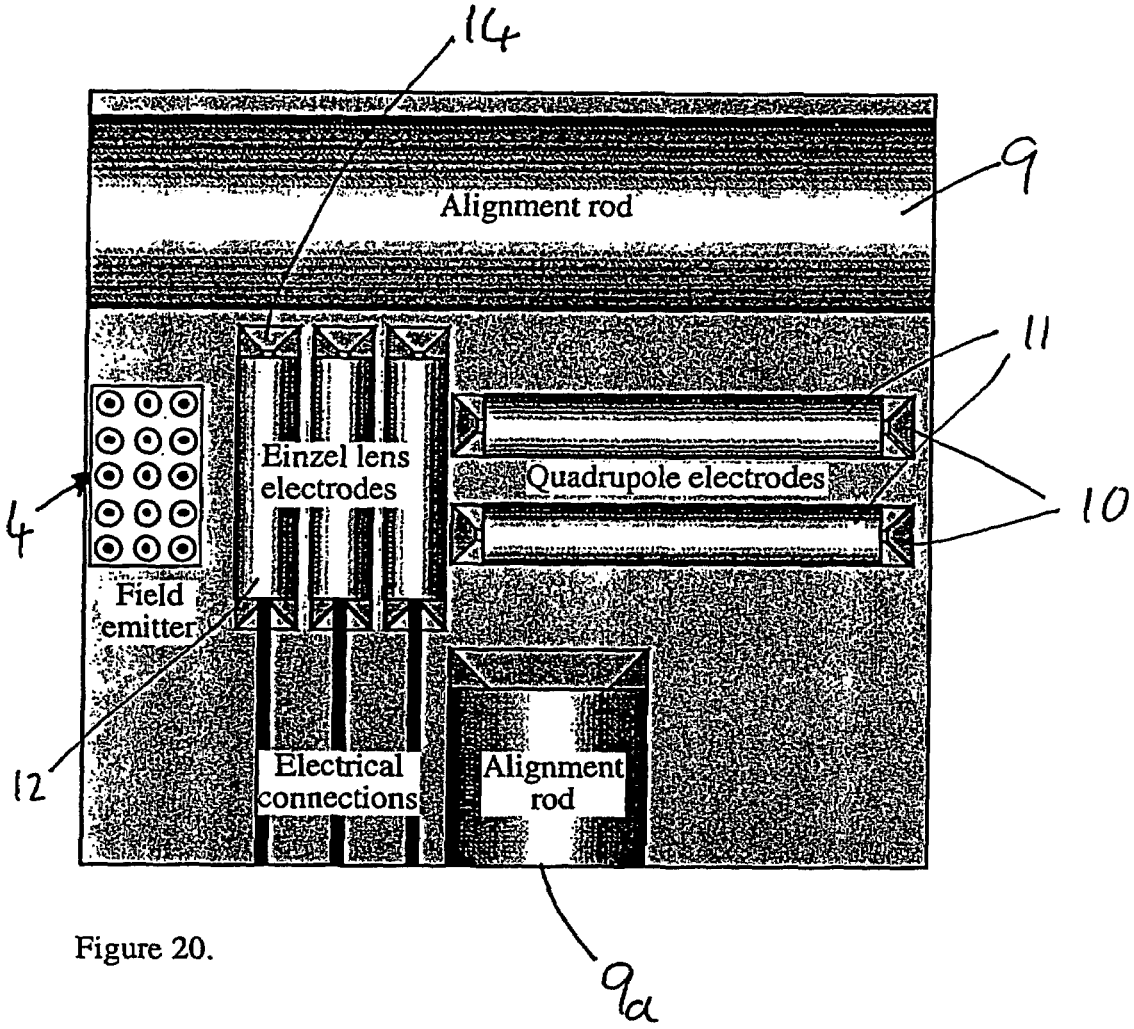
FIG. 20 shows the use of spacers that eliminate axial motion from an integrated assembly, using perpendicular cylindrical spacer rods.

The ion entrance optics may be combined with either the mass filter or the electron emitter, or all three elements may be combined. If any of the elements are separate, they may attach to the common pair of cylindrical spacer rods 9. If all three elements are combined, one of the cylindrical spacer rods 9*a* may be rotated through ninety degrees as shown in FIG. 20. Alternatively, the cylindrical spacer rod 9*a* may be replaced by a sphere, of the same diameter and located in pyramidal etched pits. Alternatively, the other rod 9 may be replaced by two spheres, so that there are three spheres in total positioned at the apices of a triangle. Either arrangement has the advantage of substantially eliminating axial motion, making the assembly truly self-aligning. A further advantage is that electrical connections may conveniently be made to one edge of the substrate.

In all the above, the three elements may be constructed as an array of devices with parallel ion paths, rather than as single devices. This arrangement has the advantage that a larger total ion current may be achieved when the devices are operated in parallel. Alternatively, the devices may be operated independently to achieve a more complex analytical function.

REFERENCES

Henry C. M. "The incredible shrinking mass spectrometer" Anal. Chem. April Issue, 264A–268A (1998)

Badman E. R., Cooks R. G. "Special feature: Perspective—miniature mass analysers" J. Mass. Spect. 35, 659–671 (2000)

Sittler F. C. "Micromachined mass spectrometer" U.S. Pat. No. 5,401,963 Mar. 28, 1995)

Freidhoff C. B., Young R. M., Sriram S. "Solid state micromachined mass spectrograph universal gas detection sensor " U.S. Pat. No. 5,386,115 Jan. 31, 1995)

Kotvas J. C., Braggins T. T., Young R. M., Freidhoff C. B. "Method for manufacturing a miniaturized solid-state mass spectrograph" U.S. Pat. No. 5,492,867 Feb. 20, 1996)

Freidhoff C. N., Young R. M. "Miniaturized mass filter" U.S. Pat. No. 5,536,939 Jul. 16, 1996)

Young R. M., Freidhoff C. B., Braggins T. T., Congedo T. V. "Micro-miniature ionizer for gas sensor applications and method of making micro-miniature ionizer" U.S. Pat. No. 5,747,815 May 5 (1998)

Freidhoff C. B. "Mass spectrograph on a chip" Proc. 1997 IEEE Aerospace Conference, Aspen, Colo., February 1–8, vol 3, p32 (1997)

Freidhoff C. B., Young R. M., Sriram S., Braggins T. T., O'Keefe T. W., Adam J. D., Nathanson H. C., Syms R. R. A., Tate T. J., Ahmad M. M., Taylor S., Tunstall J. "Chemical sensing using non-optical microelectromechanical systems" J. Vac. Sci. Tech. A17, 2300–2307 (1999)

Sun C., Carr N. W., Farmer K. R. Poster presented at 43$^{rd}$ American Vacuum Society Symposium, October (1996)

Bryden W. A., Benson R. C., Ecelberger S. A., Phillips T. E., Cotter R. J., Fenselau C. "The Tiny TOF mass spectrometer for chemical and biological sensing" Johns Hopkins APL Tech. Digest 16, 296–310 (1995)

Cornish T. J., Bryden W. A. "Miniature time-of-flight mass spectrometer for a field-portable biodetection system" Johns Hopkins APL Tech. Dig. 20, 335–342 (1999)

Yoon H. J., Kim J. H., Park T. G., Yang S. S., Jung K. W. "The test of hot emission for the micro mass spectrometer" Proc. SPIE 4408, 360–367 (2001)

Feustel A., Müller J., Relling V. "A microsystem mass spectrometer" Pp 299–304 in *MicroTotal Analysis Systems*, van den Berg A., Bergveld P., Eds., Kluwer Academic Publishers, The Netherlands (1995)

Siebert P., Petzold G., Hellenbart A., Müller J. "Surface microstructure/miniature mass spectrometer: processing and applications" Appl. Phys. A67, 155–160 (1998)

Wells J. M., Badman E. R., Cooks R. G. "A quadrupole ion trap with cylindrical geometry operated in the mass-selective instability mode" Anal. Chem. 70, 438–444 (1998)

Badman E. R., Johnson R. C., Plass W. R., Cooks R. G. "A miniature cylindrical quadrupole ion trap: simulation and experiment" Anal. Chem. 70, 4896–4901 (1998)

Zheng O. Y., Badman E. R., Cooks R. G. "Characterization of a serial array of miniature cylindrical ion trap mass spectrometers" Rapid. Comm. in Mass Spect. 13, 2444–2449 (1999)

Kornienko O., Reilly P. T. A., Whitten W. B., Ramsey J. M. "Micro ion trap mass spectrometry" Rapid. Comm. in Mass Spect. 13, 50–53 (1999)

Kornienko O., Reilly P. T. A., Whitten W. B, Ramsey J. M. "Field-emission cold-cathode E1 source for a microscale ion trap mass spectrometer" Anal. Chem. 72, 559–562 (2000)

Ferran R. J. "Residual gas sensor utilizing a miniature quadrupole array" U.S. Pat. No. 5,401,962 Mar. 28 (1995)

Ferran R. J., Boumsellek S. "High pressure effects in miniature arrays of quadrupole analyzers for residual gas analysis from $10^{-9}$ to $10^{-2}$ Torr" J. Vac. Sci. Tech. A14 1258–1264 (1996)

Boumsellek S., Ferran R. J. "Miniature quadrupole arrays for residual and process gas analysis" Journal of the IEST 42, 27–31 (1999)

Chutjian A., Hecht M. H., Orient O. J. "Miniature quadrupole mass spectrometer array" U.S. Pat. No. 5,719,393 Oct. 23 (1995)

Orient O. J., Chutjian A., Garkanian V. "Miniature, high-resolution, quadrupole mass-spectrometer array" Rev. Sci. Instrum. 68, 1392–1397 (1997)

Holkeboer D. H. "Ion lens assembly for gas analysis system" U.S. Pat. No. 5,850,084 Dec. 15 (1998)

Holkeboer D. H., Karandy T. L, Currier P. C., Frees L. C., Ellefson R. E. "Miniature quadrupole residual gas analyser for process monitoring at milliTorr pressures" J. Vac. Sci. Tech. A16, 1157–1162 (1998)

Chutjian A., Hecht M., Orient O., Wiberg D., Brennan R. A. "Miniature micromachined quadrupole mass spectrometer array and method of making the same" U.S. Pat. No. 6,188,067 Feb. 13 (2001)

Wiberg D., Hecht M., Brennan R., Bonivert W., Hruby J., Jackson K. "A LIGA fabricated quadrupole array for mass spectroscopy" Proc. HARMST '97, Madison, Wis., June 1997

Taylor S., Tate T. J., Syms R. R. A., Dorey H. A. "Quadrupole mass spectrometers" U.S. Pat. No. 6,025,591 Feb. 15 (2000)

Syms R. R. A, Tate T. J., Ahmad M. A, Taylor S. "Fabrication of a microengineered quadrupole electrostatic lens" Elect. Lett. 32, 2094–2095 (1996)

Syms R. R. A., Tate T. J., Ahmad M. M., Taylor S. "Design of a microengineered quadrupole electrostatic lens" IEEE Trans. on Electron Devices TED-45, 2304–2311 (1998)

Taylor S., Tunstall J. J., Leck J. H., Tindall R., Julian P., Batey J., Syms R. R. A., Tate T. J., Ahmad M. M. "Performance improvements for a miniature quadrupole with a micromachined mass filter" Vacuum 53, 203–206 (1999)

Batey J. H. "Quadrupole gas analysers" Vacuum 37, 659–668 (1987)

Fowler R. H., Nordheim L. W. "Electron emission in intense electric fields" Proc. Roy. Soc. 119, 173 (1928)

Spindt C. A. "A thin film-emission cathode" J. Appl. Phys. 39, 3504 (1968)

Spindt C. A., Brodie I., Humphery L., Westenberg E. R. "Physical properties of thin-film emission cathodes" J. Appl. Phys. 47, 5248 (1976)

Itoh J., Tohrna Y., Morikawa K., Kanemaru S., Shimizu K "Fabrication of double-gated Si field emitters for focused electron beam generation" J. Vac. Sci. Technol. B13, 1968–1972 (1995)

Fleming J. G., Ohlberg D. A. A., Pelter T., Malinowski M. "Fabrication and testing of vertical metal edge emitters with well-defined gate to emitter separation" J. Vac. Sci. Technol. B14, 1958–1962 (1996)

Fleming J. G., Smith B. K. "Asymmetrical field emitter" U.S. Pat. No. 5,457,355 Oct. 10 (1995)

Chang T. H. P., Kern D. P., Muray L. P. "Arrayed miniature electron beam columns for high-throughput sub-100 nm lithography" J. Vac. Sci. Tech. 10, 2743–2748 (1992)

Despont M., Staufer U., Stebler C., Germann R., Vettiger P. "Microfabrication of lenses for a miniature electron column" Microelectr. Engng. 27, 467–470 (1995)

Lee Y. J., Kang S.-H., Chun K. "Micromachined self-aligned microlens (SAM) for microcolumn electron beam" Microelectr. Engng. 35, 413–416 (1997)

Hofmann W., Chen L.-Y., MacDonald N. C. "Fabrication of integrated micromachined electron guns" J. Vac. Sci. Technol. B13, 2701–2704 (1994)

Hofmann W., MacDonald N. C. "Micromachined single crystal silicon electron lenses" J. Vac. Sci. Tech. B15, 2713–2717 (1997)

What is claimed is:

1. A mass spectrometer device comprising;

an electron source comprising a first substrate with a cathode, a gate and a locating profile on its surface, a second substrate with an anode and a locating profile on its surface and a spacer adapted to co-operate with the locating profiles to maintain the substrates at a set distance and orientation with respect to one another so that the cathode, gate and anode together form an electron source, and a mass filter comprising first and second substrates each with a mass filtering component and a locating profile on its surface.

2. A device according to claim 1 in which the substrates are oxidised silicon substrates, the locating profiles are etched grooves and the spacer is an elongate rod.

3. A device according to claim 1 in which the cathode comprises a plurality of raised points.

4. A device according to claim 1 in which the cathode comprises a plurality of raised edges.

5. A device according to claim 1 in which each substrate comprises a cathode and a gate on its surface and the gate on the surface of the second substrate forms the anode.

6. A device as claimed in claim 1 wherein the spacer is adapted also to co-operate with the locating profiles of the mass filter substrates to maintain them at a set distance and orientation with respect to one another so that the mass filtering components together form a mass filter.

7. A device according to claim 1 in which the substrates are oxidised silicon substrates and the mass filtering components each comprise two cylindrical electrodes mounted in etched grooves in the substrates.

8. A device according to claim 1 comprising a plurality of such electron sources, and mass filters coupled in parallel.

9. A device according to claim 1 further comprising an ion optical device comprising first and second substrates, each with an electrode and a locating profile on its substrate.

10. A device according to claim 9 in which the ion optical device comprises three cylindrical ion-coupling electrodes and together form a one-dimensional einzel lens.

11. A device according to claim 10 in which the substrates are oxidised silicon and the cylindrical ion coupling electrodes are mounted in etched grooves.

12. A device according to claim 9 in which the ion optical electrodes each comprise a multi-level metal electrode and together form a two-dimensional einzel lens.

13. A device according to claim 12 in which the ion optical electrodes each comprise a bi-level metal electrode.

14. A device according to claim 1 comprising a plurality of such locating profiles and spacers and in which one of the spacers is so shaped as to constrain at least one degree of freedom of relative motion of the substrates, but not all such degrees of freedom, and the remaining spacer is so shaped and positioned as to constrain the remaining degrees of freedom.

15. A device according to claim 14 in which the spacers are non-parallel elongate rods.

16. A device according to claim 14 in which the spacers are an elongate rod and an off-axis sphere.

* * * * *